US006027399A

United States Patent [19]

Stewart

[11] Patent Number: 6,027,399

[45] Date of Patent: Feb. 22, 2000

[54] CLEAN GRINDING SYSTEM

[76] Inventor: Kerry Stewart, 333 Inlet Way, Palm Beach Shores, Fla. 33404

[21] Appl. No.: 09/032,738

[22] Filed: Feb. 27, 1998

[51] Int. Cl.[7] ..... B24B 23/02

[52] U.S. Cl. ..... 451/353; 451/354; 451/451; 451/456

[58] Field of Search ..... 451/353, 354, 451/359, 456, 451; 15/418

[56] References Cited

U.S. PATENT DOCUMENTS

| | | | |
|---|---|---|---|
| 3,468,076 | 9/1969 | Jones | 51/273 |
| 3,880,047 | 4/1975 | Dosier | 90/12 D |
| 3,882,644 | 5/1975 | Cusumano | 51/170 T |
| 3,935,678 | 2/1976 | Marton | 51/170 T |
| 3,987,589 | 10/1976 | Marton | 51/170 T |
| 4,287,685 | 9/1981 | Marton | 51/170 T |
| 4,531,329 | 7/1985 | Huber | 51/273 |
| 4,765,099 | 8/1988 | Tanner | 51/170 T |
| 4,986,703 | 1/1991 | Hampl et al. | 409/131 |
| 5,105,585 | 4/1992 | Hampl et al. | 51/170 R |
| 5,125,190 | 6/1992 | Buser et al. | 51/273 |
| 5,228,244 | 7/1993 | Chu | 51/273 |
| 5,239,783 | 8/1993 | Matechuk | 51/180 |
| 5,279,076 | 1/1994 | Healy et al. | 51/273 |
| 5,292,352 | 3/1994 | Rudolf et al. | 51/283 R |
| 5,411,433 | 5/1995 | Keller | 451/451 |
| 5,527,207 | 6/1996 | Azar et al. | 451/344 |
| 5,545,082 | 8/1996 | Courson et al. | 451/456 |
| 5,609,516 | 3/1997 | Courson et al. | 451/456 |
| 5,632,579 | 5/1997 | Susnjara | 409/137 |
| 5,713,785 | 2/1998 | Nishio | 451/451 |
| 5,791,979 | 8/1998 | Duncan et al. | 451/456 |

*Primary Examiner*—Joseph J. Hail, III
*Assistant Examiner*—William Hong
*Attorney, Agent, or Firm*—Quarles & Brady LLP

[57] ABSTRACT

A grinding tool accessory for containing and removing dust formed by a grinding disk comprises: a flexible housing adapted for mounting on the grinding tool and defining a first chamber for collecting the dust prior to removal, the housing having an edge spaced from an outer perimeter of the grinding disk and defining an annular gap; the housing having an outlet adapted for connection to a source of vacuum and a dust collector; a brush extending from the edge and together with the grinding disk defining a second chamber, the brush having bristles with different lengths dimensionally related to the gap, dust being drawn from the second chamber into the first chamber through the gap and thereafter into the dust collector by the vacuum; and, the housing having at least one sealable hole to adjust the vacuum for optimizing containment and collection of the dust as the grinding tool is moved over flat and contoured portions of a work surface.

22 Claims, 5 Drawing Sheets

CLEAN GRINDING SYSTEM

BACKGROUND OF THE INVENTION

1. Field of the Invention

This invention relates to the field of grinding tools, and in particular, to a clean grinding system for use with rotary grinding tools which contains and collects substantially all dust: created during use of rotary grinding tools.

2. Description of Related Art

Rotary grinding creates enormous quantities of dust. The dust is difficult and tedious to clean up, and in some cases depending upon the nature of the material being ground, can be dangerous to people and animals in particular and the environment: in general. Fiberglass and the kind of paint used on the bottoms of boat hulls to inhibit marine growth can be especially pernicious. In fact, grinding the bottoms of boat hulls is forbidden in many places by boat yards and by the Environmental Protection Agency.

The dust also poses problems for the persons operating the grinding tools. Special protective clothing and masks are often necessary and extraordinary measures must be taken to avoid dust contamination of nearby structures. The boatyard is a good example. Typically, even if the work surface of a boat, particularly a large boat, is well shrouded, so much dust is created and dispersed that the boats on either side of the boat being refinished must also be cleaned. It is not unusual for the clean up time to exceed the grinding time. In some cases, the paint or finish being removed can damage the paint of another boat.

Some efforts have been made to incorporate dust collecting systems into grinding tools. U.S. Pat. No. 5,527,207—Azar, et al. is directed to a dust collection shroud for hand held power tools. A shroud formed in part by a flat, substantially rigid disk has an aperture located at its center that allows passage of the hand tool's drive shaft through the disk. The shroud is connected directly to the tool body by screws which appear to be original equipment to the tool. The outer perimeter of the shroud is formed by a downwardly depending brush, whose bristles extend to or slightly beyond the lower surface of the grinding disk. The bristles include a flexible plastic strip embedded therein, which helps contain the dust and vacuum and provides some stiffening support for the bristles. A vacuum hose is attached to the exhaust port in the disk. The particulates that are removed from the work piece are said to be centrifugally flung from the work piece by the rotating abrasive media and impact into the supporting brush interface. The vacuum source which is attached to the exhaust port by means of a hose, is said to cause air to flow through the supporting brush interface, suspending the loose particulate, and pulling the loose particulates out of the dust collection device. This device cannot be used on contoured work surfaces without losing dust containment. There is no apparent provision for adjusting the vacuum.

U.S. Pat. No. 4,765,099—Tanner also teaches a sanding and dust collecting apparatus. The apparatus comprises an impeller blade assembly, a spindle member, and sanding disc assembly. The housing assembly also includes an upper plate member, an impeller blade housing portion, and a brush housing portion. This structure requires the equivalent of redesigning the basic grinding tool, and in no way represents an accessory which can be used with a variety of grinding tools. The housing appears substantially rigid, and it is expected that operation on a contoured surface would raise the brush at some point, losing dust containment. There is also no apparent provision for adjusting the vacuum.

Brushes are also used for dust containment in U.S. Pat. No. 5,609,516—Courson, et al. and U.S. Pat. No. 5,279,076—Healy, et al. Insofar as brushes may be useful in dust containment, the various references fail to suggest a consensus as to an ideal configuration for such brushes. A first example is the contrary teachings of using and not using a reinforcing shield. A second example is the length of the bristles. Longer bristles might help with contour grinding, but the ends of long bristles are certain to be pulled inwardly and ground up along with the work surface, after which there will be no long bristles.

The prior art dust containment systems fail to address and solve a number of problems. A first problem is the ability to maintain dust containment when grinding a contoured or curved surface. A second problem is establishing an advantageous configuration for the brush forming the outer perimeter of the dust containment device. A third problem is the need to adjust the vacuum to compensate for different kinds of vacuum systems, different brands of rotary grinding tools and the differing nature and size of the dust particulates created by grinding different kinds of materials with different grades of grit.

SUMMARY OF THE INVENTION

The foregoing problems are solved by the clean grinding system taught herein. The first problem, posed by contoured and curved work surfaces, can be solved by a flexible housing, alone or in conjunction with a solution to the second problem. The second problem, regarding an optimum brush configuration, can be solved by providing a brush with bristles of different lengths, which lengths are dimensionally related to the gap between the outer perimeter of the grinding disk and the opposing edge of the housing. The third problem, posed by different machines, surfaces and grits, can be solved by providing at least one, and preferably a plurality of holes in the housing, which can be independently sealed, for example by plugs.

A grinding tool accessory, in accordance with an inventive arrangement for containing and removing dust formed by rotary action of a grinding disk on a work surface, comprises: a flexible housing adapted for mounting on the grinding tool and defining a first chamber for collecting the dust prior to removal, the housing having an edge opposite and spaced from an outer perimeter of the grinding disk and defining a substantially uniform annular gap; the housing having an outlet adapted for connection to a source of vacuum and a dust collecting container; a brush extending from the edge and together with the grinding disk defining a second chamber in which the dust is created during the rotary action of the grinding disk, the brush having bristles with different lengths dimensionally related to the gap, the dust being drawn from the second chamber into the first chamber through the gap and thereafter being drawn from the first chamber into the dust collecting container by the source of vacuum; and, the housing having at least one hole communicating between the first chamber and ambient pressure, the at least one hole being sealable to adjust the vacuum as applied to the first chamber for optimizing containment and collection of the dust, whereby the dust is substantially completely contained and collected during the rotary action of the grinding disk as the grinding tool is moved over flat and contoured portions of the work surface.

The housing can be a flexible plastics material, advantageously affixed to the grinding tool by hardware forming original equipment of the grinding tool. The housing preferably has a dome-like shape extending radially outwardly from points adjacent a driving shaft of the grinding tool to the edge.

The bristles advantageously increase in length from points adjacent the gap in a radially outward direction. None of the bristles is substantially greater in length than would enable the distal ends of the bristles to reach the outer perimeter of the grinding disk under the influence of the vacuum. Stated in the alternative, substantially all of the bristles have lengths which are not quite long enough to reach the outer perimeter of the grinding disk under the influence of the vacuum.

The housing advantageously comprises a plurality of holes communicating between the first chamber and the ambient pressure, one or more of the openings being independently pluggable for adjusting the vacuum.

A grinding tool accessory, in accordance with a further inventive arrangement for containing and removing dust formed by rotary action of a grinding disk on a work surface, comprises: a flexible housing adapted for mounting on the grinding tool and defining a first chamber for collecting the dust prior to removal, the housing having an edge opposite and spaced from an outer perimeter of the grinding disk and defining a substantially uniform annular gap; the housing having an outlet adapted for connection to a source of vacuum and a dust collecting container; and, a brush extending from the edge and together with the grinding disk defining a second chamber in which the dust is created during the rotary action of the grinding disk, the brush having bristles with different lengths, the dust being drawn from the second chamber into the first chamber through the gap and thereafter being drawn from the first chamber into the dust collecting container by the source of vacuum, whereby the dust is substantially completely contained and collected during the rotary action of the grinding disk as the grinding tool is moved over flat and contoured portions of the work surface.

Advantageously, the different lengths of the bristles are dimensionally related to the gap.

The housing advantageously comprises at least one hole, and preferably a plurality of holes, communicating between the first chamber and ambient pressure, one or more of the holes being independently sealable to adjust the vacuum.

A grinding tool accessory in accordance with another inventive arrangement for containing and removing dust formed by rotary action of a grinding disk on a work surface, comprises: a housing adapted for mounting on the grinding tool and defining a first chamber for collecting the dust prior to removal, the housing having an edge opposite and spaced from an outer perimeter of the grinding disk and defining a substantially uniform annular gap; the housing having an outlet adapted for connection to a source of vacuum and a dust collecting container; and, a brush extending from the edge and together with the grinding disk defining a second chamber in which the dust is created during the rotary action of the grinding disk, the brush having bristles with different lengths dimensionally related to the gap, the dust being drawn from the second chamber into the first chamber through the gap and thereafter being drawn from the first chamber into the dust collecting container by the source of vacuum, whereby the dust is substantially completely contained and collected during the rotary action of the grinding disk as the grinding tool is moved over flat and contoured portions of the work surface.

The housing comprises at least one hole, and preferably a plurality of holes communicating between the first chamber and ambient pressure, one or more of the holes being independently pluggable to adjust the vacuum.

A grinding tool accessory in accordance with yet another inventive arrangement for containing and removing dust formed by rotary action of a grinding disk on a work surface, comprises: a housing adapted for mounting on the grinding tool and defining a first chamber for collecting the dust prior to removal, the housing having an edge opposite and spaced from an outer perimeter of the grinding disk and defining a substantially uniform annular gap; the housing having an outlet adapted for connection to a source of vacuum and a dust collecting container; a brush extending from the edge and together with the grinding disk defining a second chamber in which the dust is created during the rotary action of the grinding disk, the dust being drawn from the second chamber into the first chamber through the gap and thereafter being drawn from the first chamber into the dust collecting container by the source of vacuum; and, the housing having at least one hole communicating between the first chamber and ambient pressure, the at least one hole being sealable to adjust the vacuum as applied to the first chamber for optimizing containment and collection of the dust, whereby the dust is substantially completely contained and collected during the rotary action of the grinding disk as the grinding tool is moved over flat and contoured portions of the work surface.

The housing comprises at least one, and preferably a plurality of holes communicating between the first chamber and ambient pressure, one or more of the holes being independently pluggable to adjust the vacuum.

A rotary grinding tool, in accordance with yet another inventive arrangement, comprises: a tool body having a motor driven grinding disk and at least one grip for manually moving the grinding tool over a work surface; a housing adapted for mounting on the tool body and defining a first chamber for collecting grinding dust prior to removal, the housing having an edge opposite and spaced from an outer perimeter of the grinding disk and defining a substantially uniform annular gap; the housing having an outlet adapted for connection to a source of vacuum and a dust collecting container; and, a brush extending from the edge and together with the grinding disk defining a second chamber in which the dust is created during the rotary action of the grinding disk, the brush having bristles with different lengths, the dust being drawn from the second chamber into the first chamber through the gap and thereafter being drawn from the first chamber into the dust collecting container by the source of vacuum; whereby the dust is substantially completely contained and collected during the rotary action of the grinding disk as the grinding tool is moved over flat and contoured portions of the work surface.

The housing comprises at least one hole, and preferably a plurality of holes communicating between the first chamber and ambient pressure, one or more of the holes being sealable to adjust the vacuum as applied to the first chamber for optimizing containment and collection of the dust, The housing is advantageously flexible.

The different lengths of the bristles are advantageously dimensionally related to the gap.

A rotary grinding tool according to yet another inventive arrangement comprises: a tool body having a motor driven grinding disk and at least one grip for manually moving the grinding tool over a work surface; a flexible housing adapted for mounting on the tool body and defining a first chamber for collecting grinding dust prior to removal, the housing having an edge opposite and spaced from an outer perimeter of the grinding disk and defining a substantially uniform annular gap; the housing having an outlet adapted for connection to a source of vacuum and a dust collecting container; a brush extending from the edge and together with the grinding disk defining a second chamber in which the dust is created during the rotary action of the grinding disk, the brush having bristles with different lengths dimensionally related to the gap, the dust being drawn from the second chamber into the first chamber through the gap and thereafter being drawn from the first chamber into the dust collecting container by the source of vacuum; and, the housing having at least one hole communicating between the first chamber and ambient pressure, the at least one hole being sealable to adjust the vacuum as applied to the first chamber for optimizing containment and collection of the dust, whereby the dust is substantially completely contained and collected during the rotary action of the grinding disk as the grinding tool is moved over flat and contoured portions of the work surface.

The housing comprises at least one, and preferably a plurality of holes communicating between the first chamber and ambient pressure, one or more of the holes being independently pluggable to adjust the vacuum.

DETAILED DESCRIPTION OF THE PREFERRED EMBODIMENTS

Figure 1:
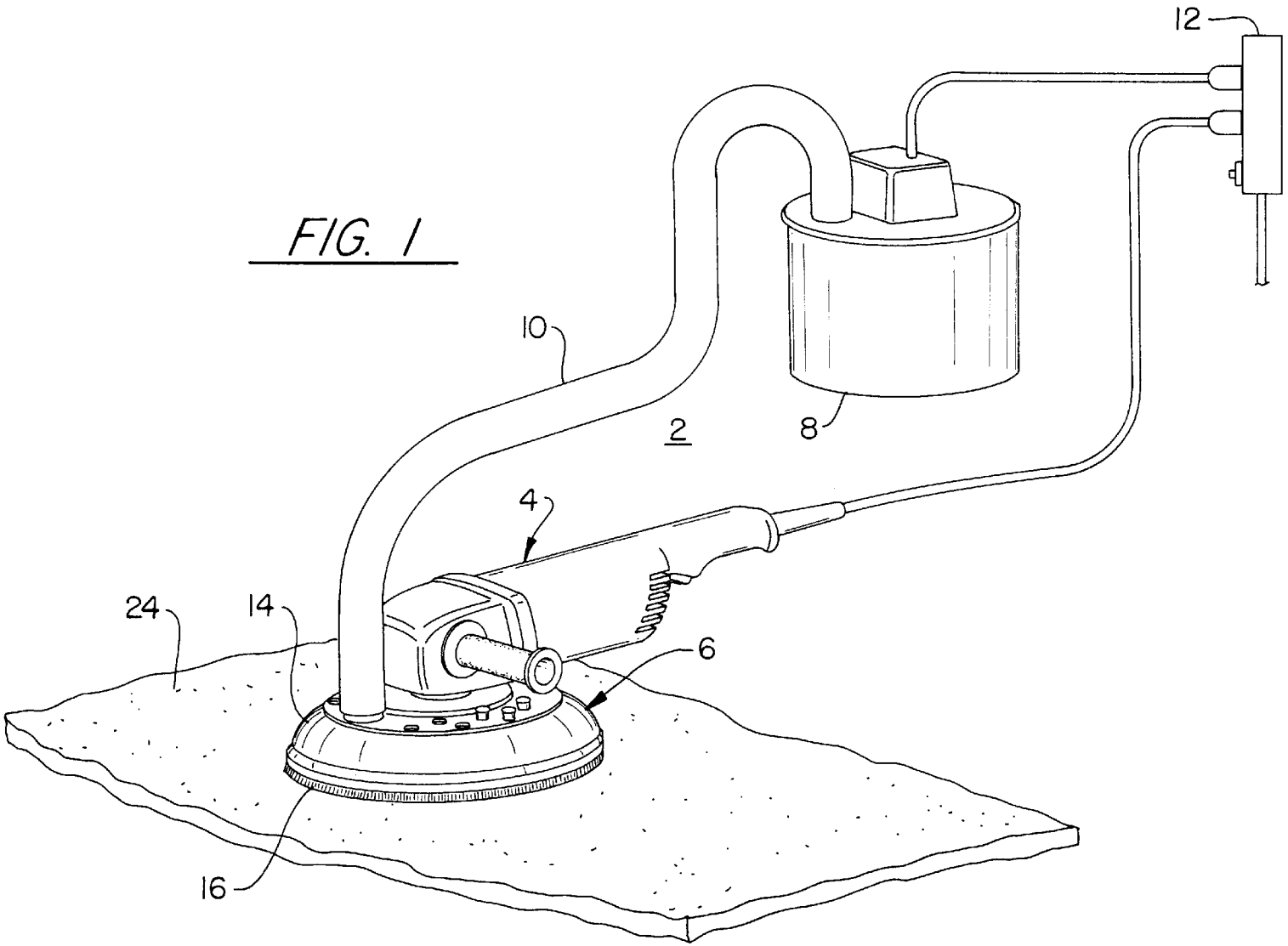
FIG. 1 is a pictorial representation of a clean grinding system in accordance with the inventive arrangements.

A clean grinding system 2 is shown pictorially in FIG. 1.

The system 2 comprises an electric disk sander or grinder 4, a clean grinding accessory 6, a source of vacuum embodied as an electric vacuum cleaner 8 and a hose 10 connecting the clean grinding accessory 6 to the vacuum cleaner 8. The grinder 4 and vacuum cleaner 8 can be operated from an AC mains supply 12. The heavy electrical load presented by such rotary grinders makes them generally unsuitable for battery power at this time, although the clean grinding system and the clean grinding accessory described and taught herein are certainly useful irrespective of the source of power for the grinder and vacuum cleaner, for example compressed air.

The grinder 4 is one of many off-the-shelf rotary sander/grinders which can be purchased from a variety of vendors and retail outlets, for example Milwaukee and Makita brand sander/grinders. Such grinders are generally operated between 5,000 revolutions per minute (rpm) and 15,000 rpm, depending upon the nature of the coating to be removed and the nature of the surface from which it is being removed. Slower speeds are usually used for sanding and higher speeds are usually used for sanding. Grinding speeds of 5,000 rpm and less are generally considered to be low speed in the industry, whereas 15,000 rpm and higher are generally considered to be high speed in the industry. Removing marine paint from a fiberglass hull generally requires grinder operation at a high speed, for example approximately 15,000 rpm. Removing marine bottom paint from the bottom of hull, fiberglass or otherwise, generally requires grinder operation at a low speed to avoid clogging and melting, for example approximately 5,000 rpm. Removing paint or varnish from a wood deck generally requires grinder operation at an intermediate speed, for example approximately 10,000 rpm. Sanding or grinding speed will also be a function of the roughness, or grit, of the sandpaper or grinding pad.

The vacuum cleaner 8 can be of the type generally described as a shop vacuum (shop-vac), also available from a variety of vendors and retail outlets.

The grinding accessory 6 comprises a housing 14 having a brush 16 depending from a circular edge 18, which is a lower edge in the orientation of FIG. 1. It should be appreciated that the grinder 4 can be used on any surface regardless of its up, down, sideways or oblique orientation. The grinder 4 has a grinding disk 20 and a grinding pad 22 thereon, not visible in FIG. 1 but visible in FIGS. 2–4 and 6. The grinding pad 22 and the brush 16 are in contact with a surface 24 to be sanded or ground away and/or smoothed.

Figure 2:
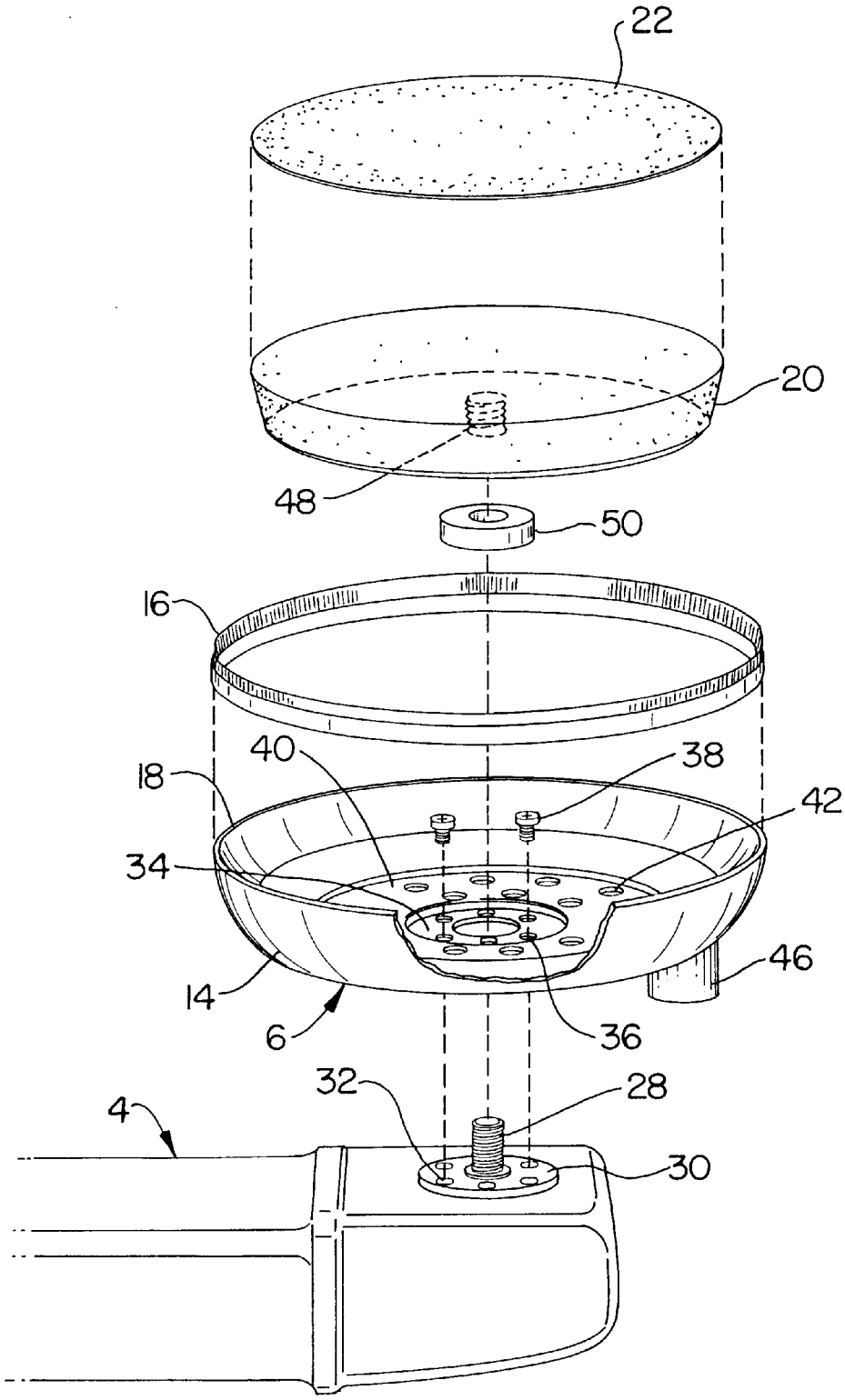
FIG. 2 is an exploded view of a clean grinding accessory in accordance with the inventive arrangements.

With reference to FIG. 2, the grinder 4 is provided with a threaded rotary drive shaft 28, which is typically driven by a motor through a gear train, both of which are conventional and neither of which is shown in the drawings. It is a particular advantage of the inventive arrangements that the grinding accessory 6 can be used with standard grinders. Shaft 28 projects through a ring 30 having a plurality of threaded holes 32, a structure which is generally common to standard grinders. This structure is used to mount a standard dust deflector/safety shield. The housing 14 of the grinding accessory 6 is advantageously provided with a mounting structure including a ring 34 of holes 36 which match the pattern of holes 32. This enables the grinding accessory to be easily attached to the grinder and detached from the grinder using the bolts 38 which are original equipment of the grinder.

The housing 14 has a substantially flat, annular portion 40 in which are located at least one, and preferably a plurality of holes 42. The holes 42 are adapted to receive respective plugs 44, which are advantageously used to adjust vacuum pressure in the grinding accessory as explained more fully in connection with FIG. 5. The portion 40 of the housing 14 is also provided with an outlet fitting 46, which can be molded integrally with the housing 14, for receiving one end of hose 10. The hose can be friction coupled or clamped.

Figure 3:
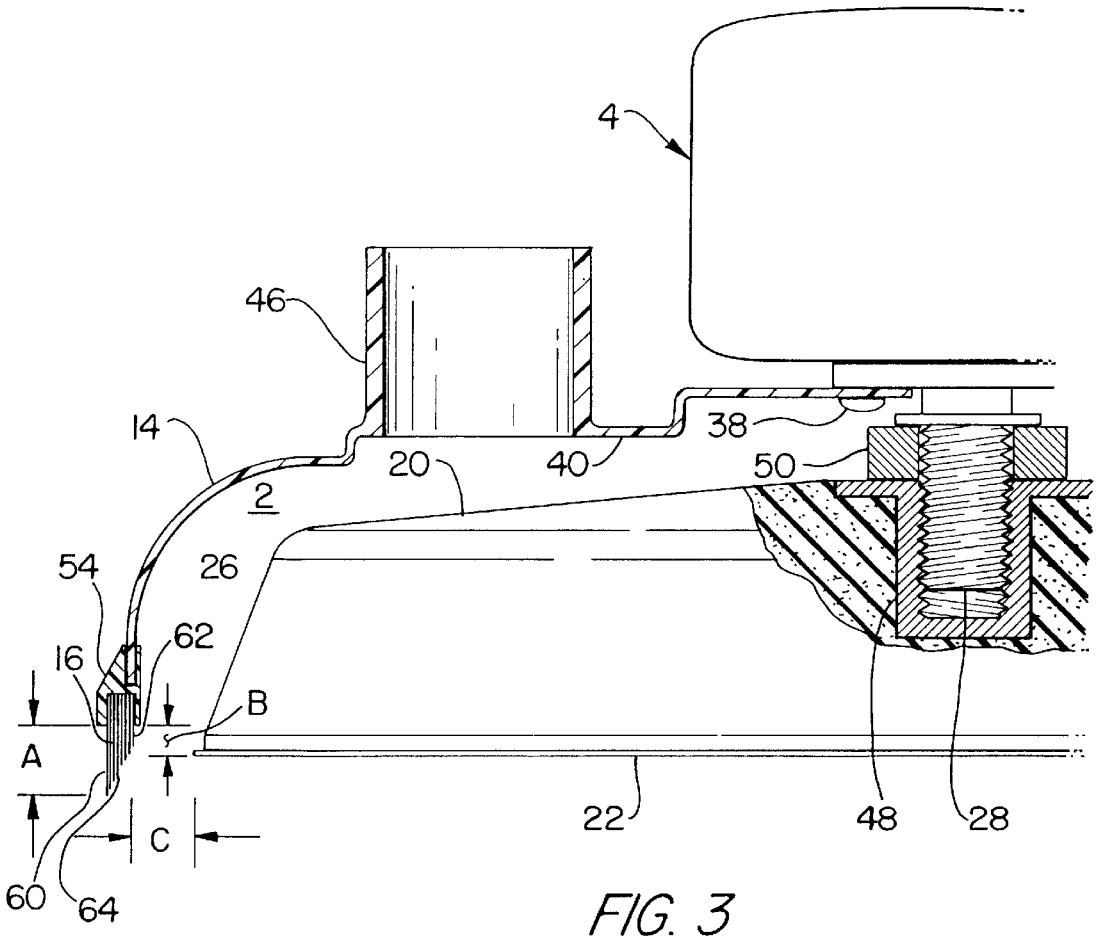
FIG. 3 is a half cross section through the clean grinding accessory shown in FIGS. 1 and 2.
Figure 4:
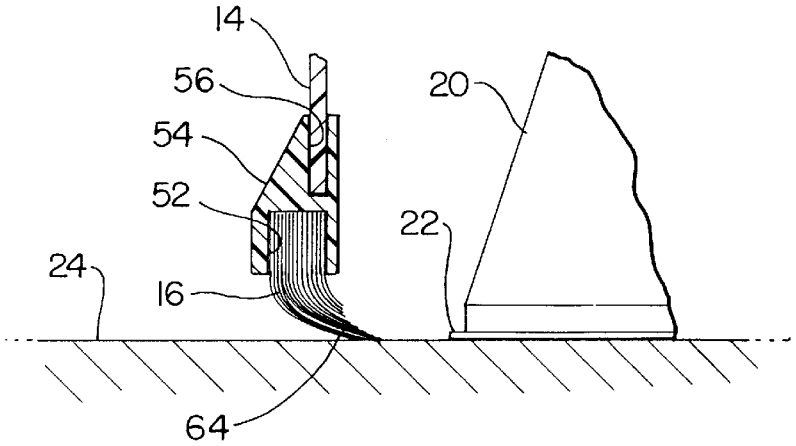
FIG. 4 is the lower left portion of FIG. 3 shown in enlarge scale.

The brush 16 is attached to the circular edge 18, as explained more fully in connection with FIGS. 3 and 4. Grinding disk 20 is provided with a threaded bushing 48 for attachment to the rotary drive shaft 28. Depending upon the particular grinder, one or more spacer rings 50 can be used to correctly position the distance of the grinding disk 20 from the grinder and within the housing 14.

Figure 7:
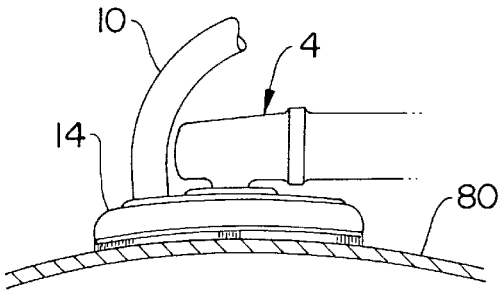
FIG. 7 is a side elevation showing clean grinding of a convex contoured surface.
Figure 8:
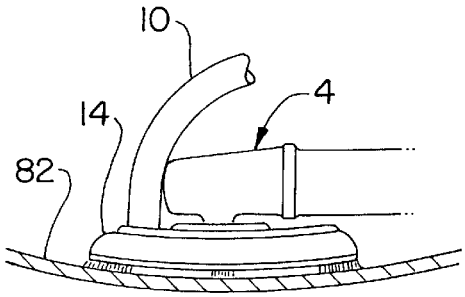
FIG. 8 is a side elevation showing clean grinding of a concave contoured surface.

With reference to FIGS. 3 and 4, the housing 14 has a curved portion 26 extending form the outer edge of annular portion 40 to the circular edge 18. The brush 16 is made from a plurality of bristles mounted in a slot 52 formed in an annular brush body 54. Brush body 54 has another slot 56, by means of which the brush can be attached to the circular edge 18 of the housing. Outermost bristles 60 of the brush extend outwardly from slot 52 by a distance A. Innermost bristles 62 of the brush extend outwardly from the slot 52 by a distance B. Distance A is larger than distance B, and the length of the bristles advantageously decreases from the outermost to the innermost, forming an angled edge 64. Distances A and B must be long enough that at least part of the edge 64 of the bristles stays in sliding contact with the surface being ground or sanded, even as the grinder is used in an angled orientation, as explained more fully in connection with FIG. 6, and even as the grinder moves over contoured surfaces, as explained more fully in connection with FIGS. 7 and 8. At the same time, the distances A and B have maximum possible lengths. The outer edge of the grinding disk 20 and grinding pad 22 are separated from the innermost bristles 62 by a distance, or clearance, C. The relationship of distances A, B and C is such that none of the bristles is long enough to reach the grinding pad 22 when deflected or otherwise drawn maximally inwardly, by movement of the grinder and by vacuum pressure, as shown in FIG. 4.

Most shop-vacs operate at only one speed. It will be appreciated that the optimal amount of vacuum pressure to contain the dust particles generated by grinding or sanding will depend upon a number of factors, including the surface or material being worked, the coarseness or smoothness of the sanding pad 22 and the pressure being applied to the surface. There must be enough vacuum to contain and collect all of the dust particles, and a the same time, there should not be so much vacuum that it becomes difficult to move the grinder over the surface. Moreover, a one-speed vacuum system represents a non-adjustable maximum amount of vacuum pressure. It will be appreciated that if the grinding accessory presents too great a load on the vacuum system, in the nature of a back pressure, it can be expected that the motor in the shop-vac will fail, the electrical circuit powering the shop-vac will fail, or both.

Figure 5:
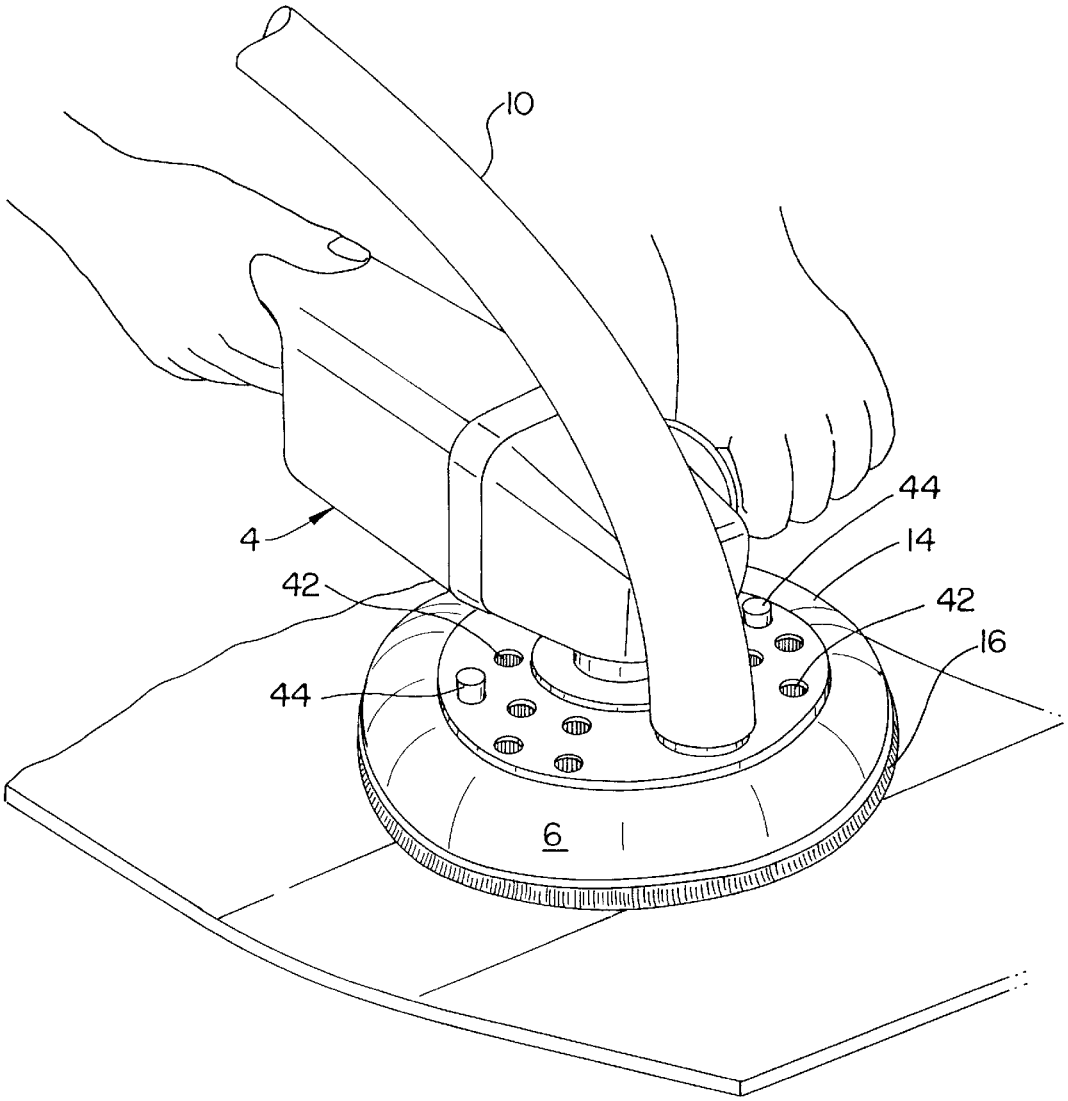
FIG. 5 is a pictorial representation useful for explaining vacuum adjustment on the clean grinding accessory.

Such problems can be advantageously overcome by the vacuum adjustment system shown most clearly in FIG. 5. The annular part 40 of the housing is provided with a plurality of holes 42, which can be used to bleed air into the housing 14 and relieve any overload and back pressure on the vacuum system. Plugs 44, which can be as simple as corks, can be selectively inserted into and removed from as many of the holes as is necessary to adjust the vacuum pressure. It is usually easy to discern when an electric motor system is overloaded, by the sound, and in more extreme cases, by the aroma of overheated components. Accordingly, the vacuum level is preferably adjusted with the grinder turned off, because the spinning disk makes the grinder easier to move and because the grinder is very noisy. Although this particular adjustment system appears to be unsophisticated, it operates easily and reliably in a high dirt and high vibration environment, and can be easily adjusted and re-adjusted without having to access the vacuum system itself.

Figure 6:
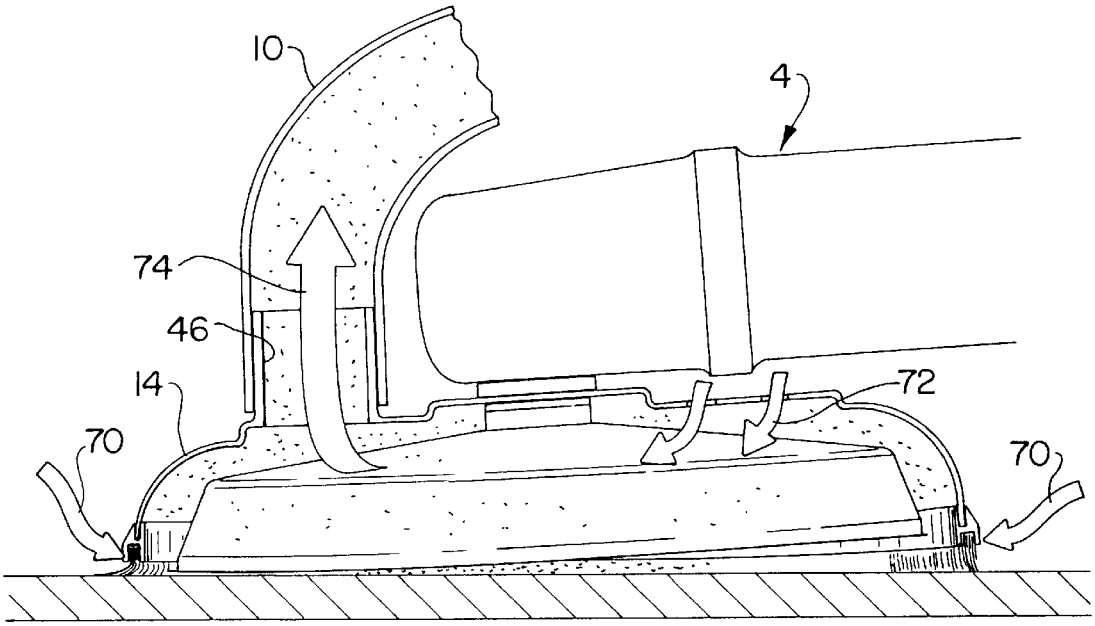
FIG. 6 is a full cross section through the clean grinding accessory useful for explaining air flow in the clean grinding accessory and showing clean grinding on an angle.

The air flow is illustrated in FIG. 6. Air can enter the housing 14 through and under the brush 16 as shown by arrows 70 and through unplugged holes 42, as shown by arrow 72 exiting through outlet 46 into hose 10 with dust particles entrained therewith, as shown by arrow 74. FIG. 6 also illustrates the manner in which dust is contained even when the grinder and housing are tilted in order to apply pressure in a particular fashion. The bristles at the left side of the brush in the orientation of FIG. 6 are maximally compressed, and may end up pointed radially outward as shown, or radially inward, depending on the direction of movement of the grinder. In either case, the dust is contained and the brush bristles do not engage or contact the grinding pad or ginding disk. The bristles at the right side of the brush in the orientation of FIG. 6 are maximally extended but still in engagement with the surface to contain the dust. The vacuum pressure increases the difficulty of tilting the grinder so far that some of the bristles move out of contact with the surface, thus risking loss of full containment. It will be appreciated that even if the brush does lose contact, the air being drawn into the housing under the bristles will still provide containment, as long as the bristles are not moved too far away. The change in the quality of the noise created by the air moving noisily under the brush, instead of quietly migrating through the bristles, will advantageously signal to an operator that the grinder is tilted too far.

The housing is advantageously made from a partially flexible material, for example a partially flexible plastics material. The housing should be flexible enough to conform to contoured surfaces, such as the concave surface 80 shown in FIG. 7 and the convex surface 82. The housing should not be so flexible that it tends to collapse and lose its basic shape if normal grinding pressure is applied. A presently preferred material for the housing is a soft, low density plastic, for example, the type sold under the LEXAN trademark. A presently preferred thickness is approximately one-eighth of an inch. Softer, more inherently resilient plastics can be expected to require a greater thickness and harder, less inherently resilient plastics can be expected to require a smaller thickness. The housing can also be made from other materials, for example rubber, having the necessary combination of resilience and structural integrity. Softer, more resilient materials can reduce potential injury if the housing breaks.

The clean grinding system described herein can be expected to contain and collect substantially all dust particles created when properly used during normal sanding and grinding operations. Nevertheless, the continued use of goggles, masks, noise baffles and other related safety equipment is strongly recommended.

The invention is not limited to the precise arrangements and instrumentalities shown, and accordingly, reference should be made to the appended claims, rather than the foregoing specification, as indicating the scope of the invention.

What is claimed is:

1. A grinding tool accessory for containing and removing dust formed by rotary action of a grinding disk on a work surface, the accessory comprising:

a flexible housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container;

a brush extending from said edge and together with said grinding disk defining a second chamber in which said dust is created during said rotary action of said grinding disk, said brush having bristles with different lengths dimensionally related to said gap, said dust being drawn from said second chamber into said first chamber through said gap and thereafter being drawn from said first chamber into said dust collecting container by said source of vacuum; and, said housing having at least one hole communicating between said first chamber and ambient pressure, said at least one hole being sealable to adjust said vacuum as applied to said first chamber for optimizing containment and collection of said dust, whereby said dust is substantially completely contained and collected during said rotary action of said grinding disk as said grinding tool is moved over flat and contoured portions of said work surface.

2. The accessory of claim 1, wherein said housing is a flexible plastics material.

3. The accessory of claim 1, wherein said housing is affixed to said grinding tool by hardware forming original equipment of said grinding tool.

4. The accessory of claim 1, wherein said housing has a dome-like shape extending radially outwardly from points adjacent a driving shaft of said grinding tool to said edge.

5. The accessory of claim 1, wherein said housing comprises a plurality of holes communicating between said first chamber and said ambient pressure, said openings being independently pluggable for adjusting said vacuum.

6. The accessory of claim 1, wherein said bristles increase in length from points adjacent said gap in a radially outward direction.

7. The accessory of claim 6, wherein none of said bristles is substantially greater in length than would enable the distal ends of said bristles to reach said outer perimeter of said grinding disk under the influence of said vacuum.

8. The accessory of claim 6, wherein substantially all of said bristles have lengths which are not quite long enough to reach said outer perimeter of said grinding disk under the influence of said vacuum.

9. A grinding tool accessory for containing and removing dust formed by rotary action of a grinding disk on a work, surface, the accessory comprising:

a flexible housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container; and, a brush extending from said edge and together with said grinding disk defining a second chamber in which said dust is created during said rotary action of said grinding disk, said brush having bristles with different lengths, said dust being drawn from said second chamber into said first chamber through said gap and thereafter being drawn from said first chamber into said dust collecting container by said source of vacuum, whereby said dust is substantially completely contained and collected during said rotary action of said grinding disk as said grinding tool is moved over flat and contoured portions of said work surface; and wherein said housing comprises at least one hole communicating between said first chamber and ambient pressure, said at least one hole being sealable to adjust said vacuum.

10. The accessory of claim 9, wherein said different lengths of said bristles are dimensionally related to said gap.

11. A grinding tool accessory for containing and removing dust formed by rotary action of a grinding disk on a work surface, the accessory comprising:

a flexible housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container; and, a brush extending from said edge and together with said grinding disk defining a second chamber in which said dust is created during said rotary action of said grinding disk, said brush having bristles with different lengths, said dust being drawn from said second chamber into said first chamber through said gap and thereafter being drawn from said first chamber into said dust collecting container by said source of vacuum, whereby said dust is substantially completely contained and collected during said rotary action of said grinding disk as said grinding tool is moved over flat and contoured portions of said work surface; and wherein said housing comprises a plurality of holes communicating between said first chamber and ambient pressure, said plurality of holes being independently pluggable to adjust said vacuum.

12. The accessory of claim 11, wherein said different lengths of said bristles are dimensionally related to said gap.

13. A grinding tool accessory for containing and removing dust formed by rotary action of a grinding disk on a work surface, the accessory comprising:

a housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container; and, a brush extending from said edge and together with said grinding disk defining a second chamber in which said dust is created during said rotary action of said grinding disk, said brush having bristles with different lengths dimensionally related to said gap, said dust being drawn from said second chamber into said first chamber through said gap and thereafter being drawn from said first chamber into said dust collecting container by said source of vacuum, whereby said dust is substantially completely contained and collected during said rotary action of said grinding disk as said grinding tool is moved over flat and contoured portions of said work surface; and wherein said housing comprises at least one hole communicating between said first chamber and ambient pressure, said at least one hole being sealable to adjust said vacuum.

14. A grinding tool accessory for containing and removing dust formed by rotary action of a grinding disk on a work surface, the accessory comprising:

a housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container; and, a brush extending from said edge and together with said grinding disk defining a second chamber in which said dust is created during said rotary action of said grinding disk, said brush having bristles with different lengths dimensionally related to said gap, said dust being drawn from said second chamber into said first chamber through said gap and thereafter being drawn from said first chamber into said dust collecting container by said source of vacuum, whereby said dust is substantially completely contained and collected during said rotary action of said grinding disk as said grinding tool is moved over flat and contoured portions of said work surface; and wherein said housing comprises a plurality of holes communicating between said first chamber and ambient pressure, said plurality of holes being independently pluggable to adjust said vacuum.

15. A grinding tool accessory for containing and removing dust formed by rotary action of a grinding disk on a work surface, the accessory comprising:

a housing adapted for mounting on said grinding tool and defining a first chamber for collecting said dust prior to removal, said housing having an edge opposite and spaced from an outer perimeter of said grinding disk and defining a substantially uniform annular gap;

said housing having an outlet adapted for connection to a source of vacuum and a dust collecting container;

a brush extending from said edge and together with said grinding disk defining a second chamber in which said dust is created during said rotary action of said grinding disk, said dust being drawn from said second chamber into said first chamber through said gap and thereafter being drawn from said first chamber into said dust collecting container by said source of vacuum; and, said housing having at least one hole communicating between said first chamber and ambient pressure, said at least one hole being sealable to adjust said vacuum as applied to said first chamber for optimizing containment and collection of said dust, whereby said dust is substantially completely contained and collected during said rotary action of said grinding disk as said grinding tool is moved over flat and contoured portions of said work surface.

16. The accessory of claim 15, wherein said housing comprises at least one hole communicating between said first chamber and ambient pressure, said at least one hole being sealable to adjust said vacuum.

17. The accessory of claim 15, wherein said housing comprises a plurality of holes communicating between said first chamber and ambient pressure, said plurality of holes being independently pluggable to adjust said vacuum.

18. A rotary grinding tool, comprising:

a tool body having a motor driven grinding disk and at least one grip for manually moving said grinding tool over a work surface;

a housing adapted for mounting on said tool body and defining a first chamber for collecting grinding dust prior to removal, said housing having an edge opposite and spaced from an outer perimeter of said grinding disk and defining a substantially uniform annular gap;

said housing having an outlet adapted for connection to a source of vacuum and a dust collecting container; and, a brush extending from said edge and together with said grinding disk defining a second chamber in which said dust is created during said rotary action of said grinding disk, said brush having bristles with different lengths, said dust being drawn from said second chamber into said first chamber through said gap and thereafter being drawn from said first chamber into said dust collecting container by said source of vacuum, whereby said dust is substantially completely contained and collected during said rotary action of said grinding disk as said grinding tool is moved over flat and contoured portions of said work surface; and wherein said housing comprises at least one hole communicating between said first chamber and ambient pressure, said at least one hole being sealable to adjust said vacuum as applied to said first chamber for optimizing containment and collection of said dust.

19. The rotary grinding tool of claim 18, wherein said housing is flexible.

20. The rotary grinding tool of claim 19, wherein said different lengths of said bristles are dimensionally related to said gap.

21. The rotary grinding tool of claim 18, wherein said different lengths of said bristles are dimensionally related to said gap.

22. A rotary grinding tool. comprising:

a tool body having a motor driven grinding disk and at least one grip for manually moving said grinding tool over a work surface;

a flexible housing adapted for mounting on said tool body and defining a first chamber for collecting grinding dust prior to removal, said housing having an edge opposite and spaced from an outer perimeter of said grinding disk and defining a substantially uniform annular gap;

said housing having an outlet adapted for connection to a source of vacuum and a dust collecting container;

a brush extending from said edge and together with said grinding disk defining a second chamber in which said dust is created during said rotary action of said grinding disk, said brush having bristles with different lengths dimensionally related to said gap, said dust being drawn from said second chamber into said first chamber through said gap and thereafter being drawn from said first chamber into said dust collecting container by said source of vacuum; and, whereby said dust is substantially completely contained and collected during said rotary action of said grinding disk as said grinding tool is moved over flat and contoured portions of said work surface; and wherein said housing comprises a plurality of holes communicating between said first chamber and ambient pressure, said plurality of holes being independently pluggable to adjust said vacuum.

* * * * *